United States Patent [19]

Zaman et al.

[11] Patent Number: 4,938,428

[45] Date of Patent: Jul. 3, 1990

[54] WIRE WINDING SYSTEM WITH MOBILE TRANSFER CART

[75] Inventors: Mohammad F. Zaman; David J. Lothamer; James Gerencser, all of Ft. Wayne, Ind.

[73] Assignee: Essex Group, Inc., Fort Wayne, Ind.

[21] Appl. No.: 373,042

[22] Filed: Jun. 28, 1989

[51] Int. Cl.[5] ..... B65H 67/04

[52] U.S. Cl. ..... 242/25 R; 242/35.5 A

[58] Field of Search ..... 242/25 R, 25 A, 18 R, 242/18 A, 35.5 A

[56] References Cited

U.S. PATENT DOCUMENTS

| | | | |
|---|---|---|---|
| 3,201,055 | 8/1965 | Guenther et al. | 242/25 R |
| 4,071,199 | 1/1978 | Jones | 242/25 A |
| 4,615,493 | 10/1986 | Teranishi et al. | 242/35.5 A |
| 4,708,298 | 11/1987 | Allard et al. | 242/25 A |
| 4,834,308 | 5/1989 | Maccaferri | 242/35.5 A |

*Primary Examiner*—Stanley N. Gilreath

*Attorney, Agent, or Firm*—Allegretti & Witcoff, Ltd.

[57] ABSTRACT

A wire winding system has a plurality of stations, each with a single take-up turntable driven by a variable speed motor. A mobile transfer cart is moveable to a selected station and is operable to effect transfer of the winding of wire from the full spool on the turntable to a take-up spool on the mobile transfer cart and then after the full spool at the turntable is removed and replaced by an empty spool, the mobile transfer cart will effect transfer of the winding of wire to the empty spool on the turntable. The take-up spool on the mobile transfer cart is constructed and arranged to have its effective outer diameter reduced in order to readily effect removal of the wire wound thereon after the wire is transferred to the empty spool on the turntable.

16 Claims, 5 Drawing Sheets

34
33
15
36
35
58
62
60
41
43
47
50
42
48
74
54
52
49
49'
51
109
105
46
45
40
44
82
84
54
52
80
42
43
44
47
101
102
46
86
105
92
88
94
53
103
51
109
110
108
60
49
49'
90
76
74
104
111
70
72
113
78
40
106
72

Fig. 8
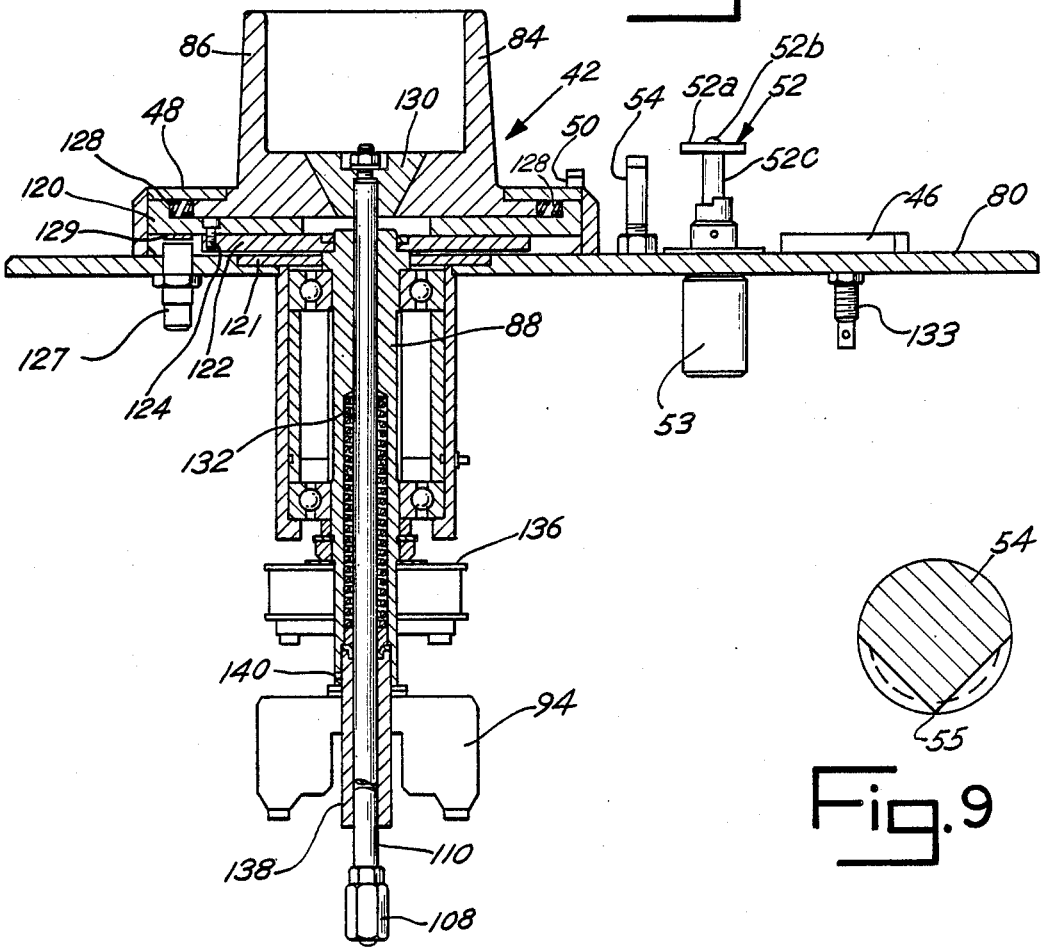
Fig. 9
Fig. 10
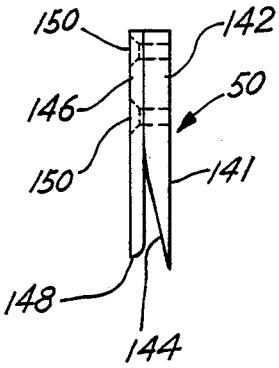
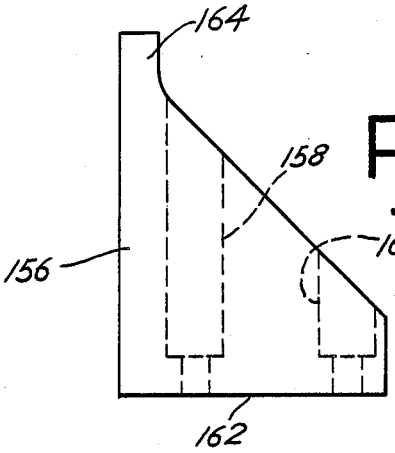
Fig. 11
Fig. 12
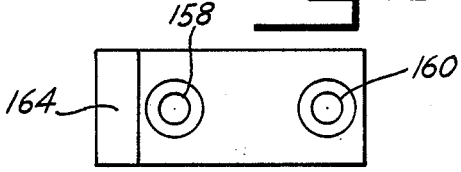

43
44
169
171
45
175
173
170
172
174
181
46
180
16
182
105

WIRE WINDING SYSTEM WITH MOBILE TRANSFER CART

BACKGROUND OF THE INVENTION

The present invention relates to a wire winding system and more particularly to a wire winding system with a take-up spool at each of a plurality of stations and to means for effectively transferring wire continuously from a full spool to an empty spool at each station by use of a mobile transfer cart, which services a plurality of stations.

In a wire winding system used in the manufacture of insulated wire, a plurality of wires are ordinarily advanced continuously by capstan assemblies from an extruder or enameler to a take-up mechanism for each wire. Each capstan assembly operates at a substantially constant linear speed to draw a wire at substantially constant speed. The tension in the wire is maintained substantially constant.

To insure continuous operation of the manufacturing process, e.g., extrusion of the wire without breakage of the wire, it is common that the take-up mechanism operate continuously with successive or adjacent pairs of spools. When one spool is filled with wire, the wire is transferred or cutover to the adjacent empty spool. The full spool is removed and replaced with an empty spool. Examples of take-up mechanisms operable with pairs of spools are O'Grady 3,368,765, Brown 3,701,491, Mailleser 3,814,340 and Graham 4,808,971. While such take-up mechanisms are generally satisfactory, they require considerable floor space, since at each operating station, there are two turntables with a spool in place on each turntable. One spool is empty (idle) while the other spool is being filled with wire.

An object of the present invention is to provide an improved wire winding system having a plurality of stations, with only a single turntable at each station, thereby requiring about fifty percent less floor space as compared with prior wire winding systems having take-up mechanisms with a pair of turntables at each station.

Another object of the present invention is to provide a mobile transfer cart for effecting transfer of the winding of wire from a spool on a variable speed turntable at a station of a wire winding system to the mobile transfer cart while the full spool is exchanged for a empty spool on the variable speed turntable and for effecting transfer of the winding of wire back to the empty spool on the variable speed turntable.

Still another object of the present invention is to provide an improved wire winding system including a plurality of stations with a single turntable at each station and a mobile transfer cart for enabling replacement of a full spool at a selected station with an empty spool at relatively high speeds (on the order of 1,100 feet per minute) on small wire filament.

Yet another object of the present invention is to provide an improved method utilizing a mobile transfer cart for changing spools in a wire winding system having a plurality of stations, with a single variable speed turntable carrying a spool at each station.

Other objects and advantages of the present invention will be made more apparent hereinafter.

BRIEF DESCRIPTION OF THE DRAWINGS

There is shown in the attached drawing a presently preferred embodiment of the present invention, wherein like numerals refer to like elements in the various views and wherein:

FIG. 8 is a transverse sectional view of the mobile transfer cart, better illustrating the construction of the take-up jaw means;

FIG. 9 is a transverse cross-sectional view of a wire cutter;

FIG. 10 is a side view of a wire snagger;

FIG. 11 is a plan view of an orientation block on the mobile transfer cart;

FIG. 12 is a side elevational view of the orientation block;

DETAILED DESCRIPTION OF THE INVENTION

Figures 1, 1A, 2, 3:
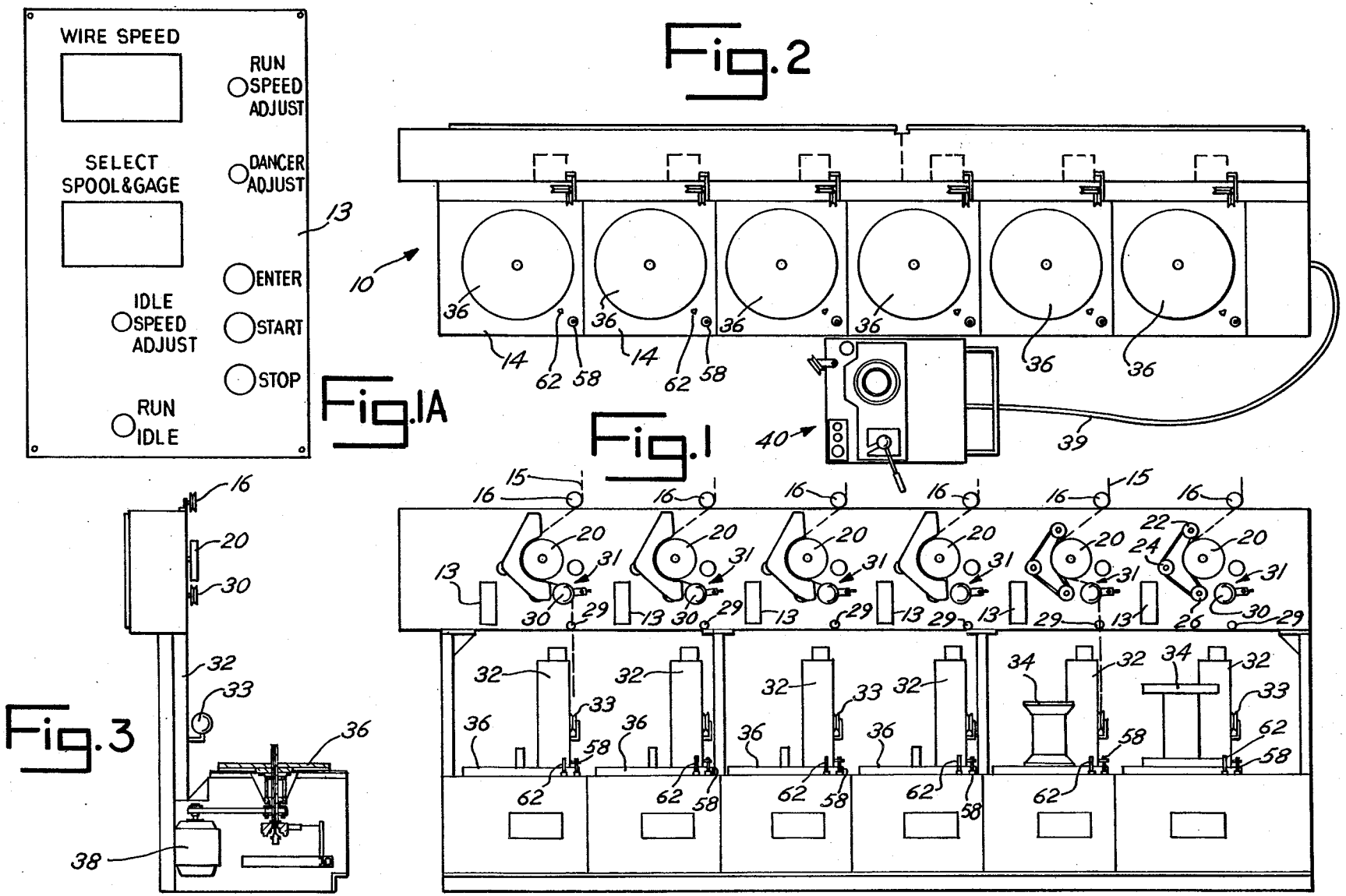
FIG. 1 is a schematic elevational view of a wire winding system with which the transfer cart assembly of the present invention may be used.
FIG. 1A is a front view of a control panel on the frame of the wire winding system.
FIG. 2 is a schematic plan view of the wire winding system of FIG. 1, illustrating the mobile transfer cart in position for use at one of the stations of the wire winding system.
FIG. 3 is a schematic end view of the wire winding system of FIGS. 1 and 2.

Referring now to FIGS. 1–3, there is illustrated a wire winding system 10 which includes a main frame 12 having a plurality of take-up stations 14 thereon. As illustrated, there are six take-up stations on the main frame 12. A control panel 13 is provided at each station and operatively connected to a master controller for the components on the main frame 12. Wire from a process operation such as an enameler or an extruder passes over the pulley 16 and then through the capstan assembly 18 which includes a capstan pulley 20 and a plurality of pulleys 22, 24 and 26 over which a belt 28 is trained. The belt 28 maintains the wire in contact with the capstan pulley 20. The capstan assembly 18 is adapted to be rotated at a constant speed so as to draw the wire from the process operation at a constant speed. The wire speeds may be on the order of 500–1100 feet per minute.

Though the wire winding system 10 has been shown as having six adjacent stations, with a single turntable at each station 14, it will be understood that the wire winding system may comprise any number of stations arranged in a row or in adjacent rows.

From the capstan assembly 18, the wire 15, passes over the dancer pulley 30 of the dancer assembly 31. The dancer assembly 31 functions to maintain a relatively constant predetermined tension on the wire.

Mounted on the frame 12 in the path of the wire 15 is a broken wire switch 29. The broken wire switch 29 is of the capacitance type and senses the presence of the wire. If the wire breaks, the broken wire switch 29 will be activated to terminate operation of the wire winding system 10.

The wire passes from the dancer pulley 30 over a traverse pulley 33 on traverse mechanism 32 to a take-up spool 34 on a turntable 36 at a take-up station 14. Two different spools 34 that may be used are shown schematically in FIG. 1. The traverse mechanism 32 adjusts reversal points of the wire as the wire is wound on the spool 34 to form a constant pitch winding in successive helical layers. The traverse mechanism 32 is of a known type, e.g. as shown in Lothamer 4,725,010, which patent is incorporated herein by reference. The turntable 36 is adapted to be driven by a variable torque motor 38 operatively connected to the turntable 36 in order to effect drawing of the wire on to the take-up reel or spool 34 in a uniform tension.

With reference to FIG. 1A, there is better shown the face of the control panel 13. The box bearing the legend Wire Speed provides a digital readout of the wire speed. The circle bearing the legend Run Speed Adjust is a rotary knob for adjusting the speed of the motor means driving the capstan assembly 18. The circle bearing the legend Dancer Adjust is a rotary knob that is operatively connected to the dancer assembly 30 for allowing the operator to center the dancer pulley position. The Enter, Start and Stop legends are adjacent to push buttons for controlling the entry of data, and the starting and stopping of the wire winding system 10.

The legend Select Spool and Gage is adjacent a rotary thumb wheel that is operatively connected to the traverse means 32. The rotary thumb wheel functions as a selection means for selecting a specific spool geometry associated with a specific spool from a plurality of possible preprogrammed spool geometries.

The legend Run Idle is adjacent a toggle switch that selects the capstan assembly speed. The Idle position is for set up on emergency situations. The Run position is for normal operation.

The legend Idle Speed Adjust is adjacent a rotary knob that selects the capstan speed for the idle mode of operation.

A feature of the present invention is the mobile transfer cart 40 which is adapted to be selectively positioned at one of the stations 14 so as to effect transfer of the winding of wire from a full spool at the selected station to the mobile transfer cart and after changing the full spool at the station for an empty one, effecting transfer of the winding of the wire back to such empty spool. The mobile transfer cart 40 is operatively connected to the components on the frame 12 of wire winding system 10 through electrical cable 39 (FIG. 2).

Figure 4:
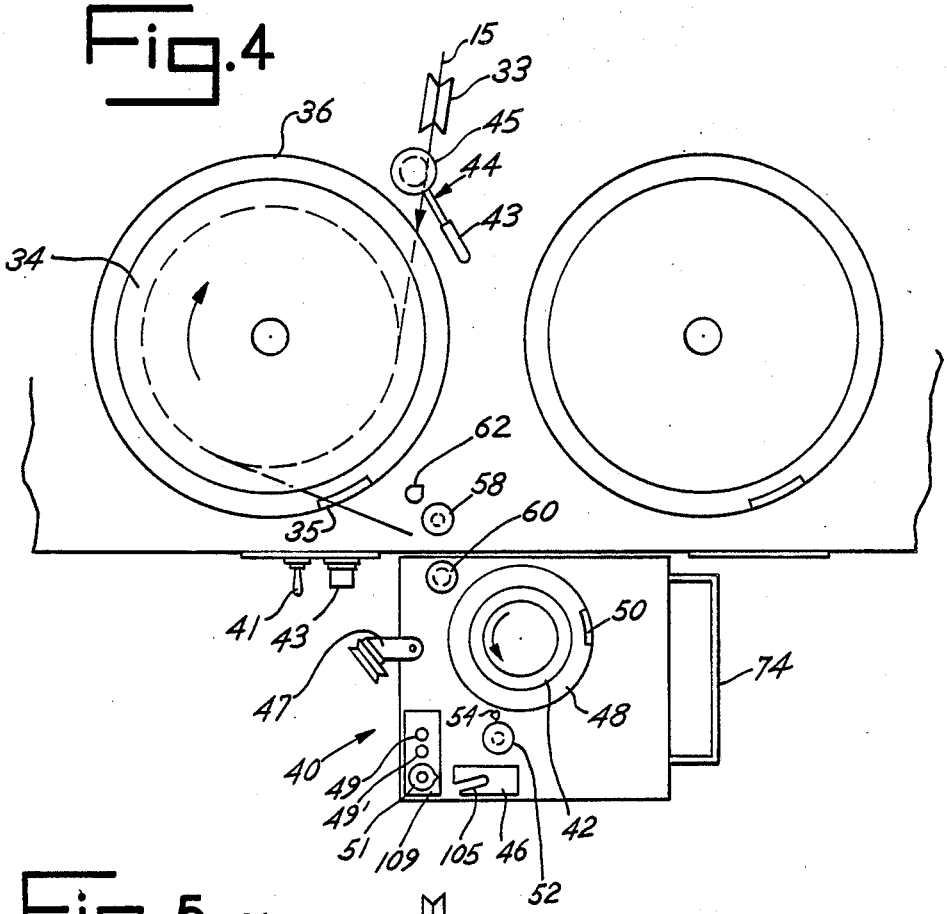
FIG. 4 is a schematic plan view of the wire winding system, with the mobile transfer cart in position adjacent one single spool station, illustrating the wire being wound onto a spool at the station and prior to the start of the transfer operation.
Figure 5:
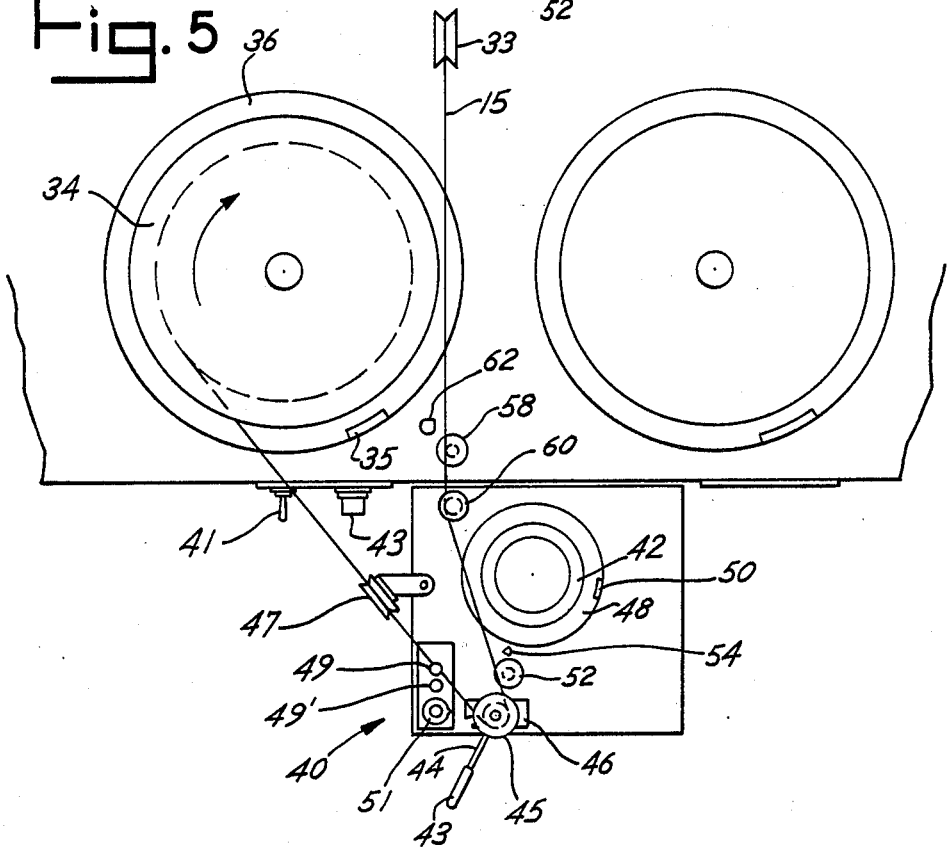
FIG. 5 is a schematic plan view similar to FIG. 4 illustrating the baton in place on the mobile transfer cart, with the wire positioned to be taken up by the take-up jaw means on the mobile transfer cart.
Figures 6, 7:
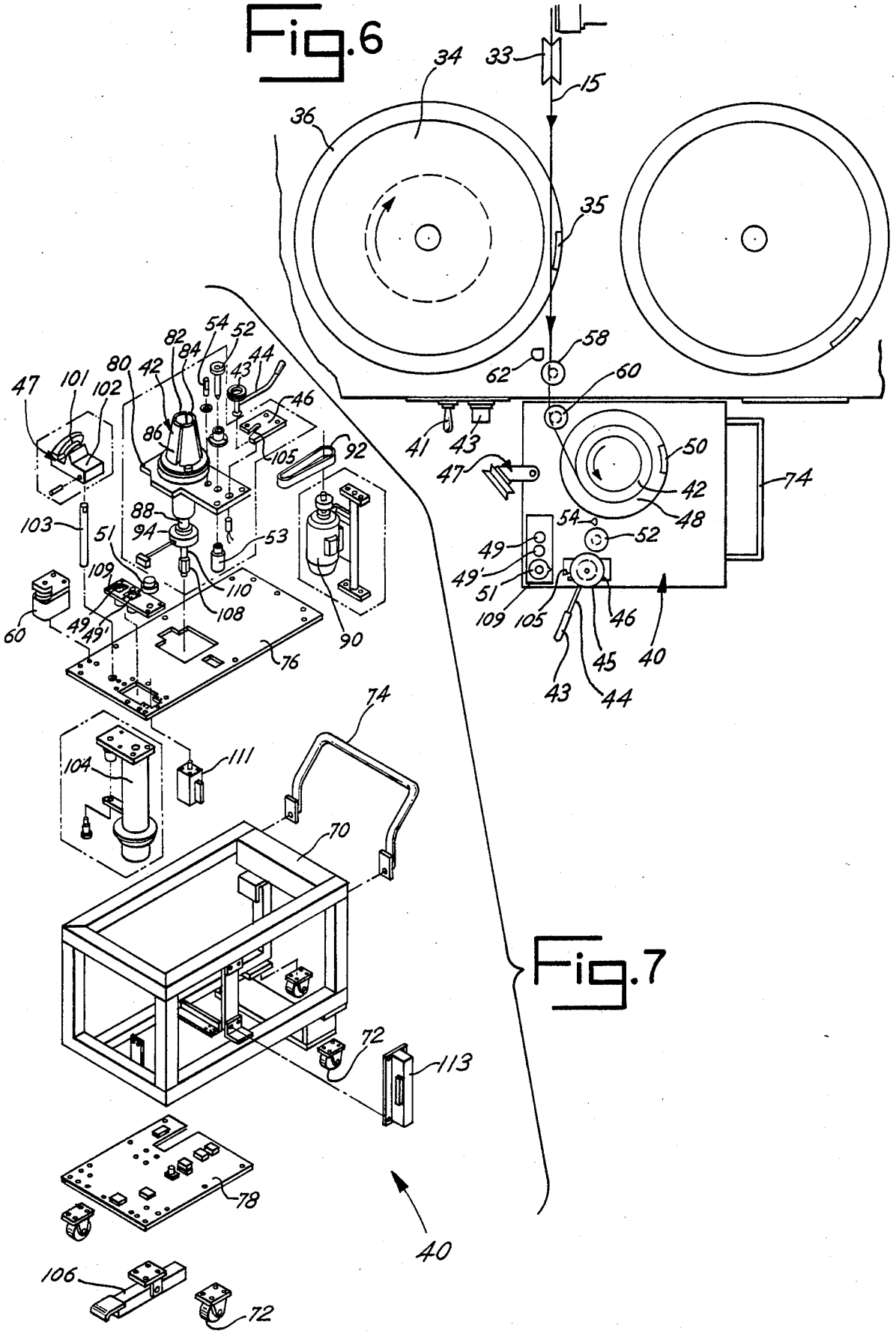
FIG. 6 is a schematic plan view similar to FIG. 4, illustrating the wire being wound onto the take-up jaw means on the mobile transfer cart and just prior to transfer of the wire for take-up on the empty spool at the station.
FIG. 7 is an exploded view of the mobile transfer cart better illustrating the major components thereof, and with the side, front and back panels omitted.

With reference now to FIGS. 4 through 6, the overall operation of the mobile transfer cart 40 may be better understood. As seen in FIG. 4, the wire 15 is being wound on to the spool 34 at a station 14. As the spool 34 becomes nearly full, the operator moves the cart 40 into position adjacent the frame 12 of the wire winding machine. The start button is designated 49 and the stop button is designated 49'. Tension knob 51 is actuated to place a desired tension upon the wire to be wound on the take-up jaw means 42. The traverse mechanism 32 will be moved to the correct height for transfer of wire to the mobile transfer cart 40. The plunger 52 is lifted. The operator actuates the transfer toggle switch 41. This signals the machine master controller which station 14 is being transferred and whether wire is being wound on spool 34 or the jaw means 42 on the transfer cart 40.

The operator engages the wire 15 with a baton 44 which has a pulley 45 journalled on the end thereof remote from handle 43 and moves the baton 44 from the position shown in FIG. 4 to the position on the cart 40 shown in FIG. 5. The baton 44 is then positioned in a baton support bracket 46 with the wire 15 adjacent to but spaced from the top of the jaw retaining ring or turntable 48 upon which the jaw means 42 is rotatably supported and below the head of the plunger 52. Inserting the baton 44 into bracket 46 actuates a sensor which causes the traverse means 47 to operate and prevent undesirable build up of wire in a limited region on spool 34.

With the baton 44 retained in its bracket 46, wire passes over guide pulley 60 on mobile transfer cart 40, pulley 45 on the baton 44 and over the traverse means 47, which are operatively positioned on the mobile transfer cart 40 for vertically adjusting the wire 15 wound on the spool 34 prior to the exchange of spools on the turntable 36.

Carried on the jaw retaining ring 48 is a wire snagger 50. The wire 15 is above the wire snagger 50 at the time that the baton 44 is positioned on its support bracket 46. When it is desired to transfer the take-up of wire on to the take-up jaw means 42 on the transfer cart 40, the operator actuator pushes button 49 on the cart 40. The jaw means 42 is rotated to desired speed. The plunger 52 is solenoid actuated to draw the wire 15 downwardly where it can be grabbed by the wire snagger 50 secured to and rotating with the turntable 48. The wire snagger 50 grips the wire and winds it upon the jaw means 42. The wire is drawn against the cutter 54 and cut. The turntable 36 is braked to a stop. The operator takes the full spool 34 from the station 14 and replaces it with an empty spool. Wire is accumulated upon the jaw means 42 during the exchange of the empty spool for the full spool on turntable 36 at the selected station 14.

During this time, the wire 15 is passed under the plunger means 58 on the machine 12 and about the wire guide means 60 on the cart 40. As shown in FIG. 6, the wire 15 is being wound upon the jaw means 42 and is above the wire snagger 35 on the turntable 36.

In order to wind the wire 15 on to the empty spool at the station 14, the operator must first switch toggle switch 41 to run position and press the start button 43. This starts the turntable 36. The plunger 58 is actuated by its solenoid when the turntable 36 reaches the desired speed and the wire is moved down toward the top surface of the turntable 36. The wire snagger 35 on turntable 36 on frame 12 will grip the wire 15 and draw it across the face of the wire cutter 62. The wire 15 will be cut and winding will continue on the empty spool. A foot actuated mechanism may be actuated on the cart 40 in order to permit the jaws means 42 to effectively come together or move inwardly and reduce the effective outer diameter thereof to permit withdrawal of the wire wound on the jaw means 42. The cart 40 may then be moved to another station where the transfer operation can be repeated.

Briefly then the method exemplified in FIGS. 4 through 6 includes positioning the cart 40 adjacent a spool at a station 14 prior to the spool reaching its full capacity. The operator guides the wire being wound onto one of the spools 34 into position adjacent the empty take-up jaw means 42 on the mobile transfer cart utilizing the baton 44. The jaw means 42 is rotated to a predetermined speed to maintain the desired tension on the wire. The wire snagger 50 will snag the wire and draw it against the cutter 54, where it is cut. The wire 15 is now wound onto the jaw means 42. The turntable 36 is stopped and the full spool on the turntable 36 is removed and replaced with an empty spool. The turntable 36 is then rotated to bring the empty spool thereon up to desired speed. The plunger 58 is actuated so that the wire snagger 35 may snag the wire and commence winding wire on to the empty spool. The wire will be drawn against the face of the cutter 62 and cut. This is done while maintaining a desired tension on the wire being wound on to the spool 36. The rotation of the take-up jaw means 42 is stopped. The foot actuated mechanism on the cart 40 is operated in order to reduce the effective outer diameter of the jaw means 42. The wound wire is removed from jaw means 42 and scrapped. The mobile transfer cart 40 may then be moved to a position adjacent another of the spools upon which wire is being wound and the transfer operation is repeated.

Turning now to FIGS. 7 and 8, there is better illustrated the operational components of the mobile transfer cart 40. The mobile transfer cart 40 includes a frame 70 adapted to be supported on casters 73 for movement on the floor adjacent the wire winding system. The rear casters may be fixedly mounted on the frame 70 and the front casters may be universally mounted or swivelly mounted on frame 70 to facilitate movement and positioning of cart 40. A handle 74 is suitably secured to the frame 70 to help facilitate movement of the frame 70. Secured to the frame 70 are side panels (not shown). Also secured to the frame 70 is a top cover 76 and a bottom cover 78.

Connected to the top cover 76 by suitable fastening means is the spindle housing base plate 80 which is adapted to support the take-up jaw means 42.

Operatively secured to the jaw means 42, which is comprised of three transfer spool jaws 82, 84, and 86 is a spindle shaft 88. The spindle shaft 88 is operatively connected by a belt member 92 to a variable speed torque motor 90 housed within the frame 70. The torque motor 90 is controlled by a variable voltage device which was preset for the wire size and speed of operation desired. Electric brake means 94 are provided concentric to the spindle shaft 88 for stopping same as desired in the operation of the mobile transfer cart 40.

Also secured to the top cover 76 of the mobile transfer cart 40 are wire guide means 60, which are operatively positioned on the mobile transfer cart 40 for guiding the wire 15 during the exchange of spools on the turntable 36 at a selected station 14 of the wire winding system. Traverse means 47 is positioned on the mobile transfer cart 40 and operates to vertically adjust the wire on the spool 34 prior to the exchange of spools on the turntable 36 to prevent undesired build up of wire in one place. The traverse means 47 includes a pulley 101 carried in holder 102. Traverse shaft 103 is affixed at one end to the holder 102 and at the other end to the vertical traverse assembly 104, which is secured to the underside of the top cover plate 76. The vertical traverse assembly 104 includes a motor drive screw for moving the traverse shaft 103 and the holder 102 secured thereto up and down.

The mounting bracket 46 for the baton 44 is suitably affixed to the top plate 76 as, for example, by cap screws. Bracket 46 includes a slot or opening 105 for receiving the baton 44.

Mounting bracket 109 supports start push button 49, stop bush button 49' and tension control 51. The tension control 51 is operatively connected to the variable transformer 111 on the frame 70. Programmable controller 113 is also secured to frame 70.

The plunger 52, which includes a washer-like head secured to a shaft, is operatively connected to a pull down solenoid or solenoid actuator 53 which is secured to underside of the top cover 76 of the mobile transfer cart 40.

The wire cutter 54 is secured to the top cover 76 between the jaw means 42 and the plunger 52. The push button actuators 49 and 51 are secured to a support 109 that is in turn connected to the top cover 76 of the mobile transfer cart 40.

Pivotally secured to the bottom 78 of the mobile transfer carb 40 is a foot pedal actuator 106 which is adapted to engage with an actuator 108 on the bottom of the spindle control rod 110 for moving the spindle control rod 110 axially. The spindle control rod 110 is operatively secured to the jaws 82, 84, 86 for effecting a change in the effective outer diameter thereof. As noted, the effective outer diameter is reduced to permit removal of wire wound thereon during the cutover or transfer operation. When the transfer operation is completed, the foot pedal actuator 106 may be pressed downwardly so as to move the control rod 110 upwardly and thereby reduce the effective outer diameter of the jaw means 42 as will be explained more fully hereinafter.

Turning to FIG. 8, there is better shown the assembly of components on the spindle housing base plate 80. The plunger 52 and its operating solenoid 53 are secured to the base plate 80 on opposite sides thereof. The plunger 52 comprises a transversely disposed washer-like head **52*a* secured by a screw 52*b* to a shaft 52*c*. Adjacent to the plunger 52 is the wire cutter 54. As noted above, the jaw means 42 includes the jaws 82, 84 and 86 which are operatively assembled on the top of the spindle housing base plate 80. The three jaws 82, 84, 86 rest on a jaws base plate 120, which is joined to the jaws base plate mounting flange 122 by suitable means, for example, cap screws 124. The three jaws 82, 84, 86 are retained in position by the jaw retaining ring 48. A plurality of springs 128 bear against the outer periphery of the individual jaws 82, 84, 86 and urge the jaws inwardly. In a preferred embodiment of the invention, there are three springs 128 for each of the jaws 82, 84, 86**.

Suitably affixed to the top of the jaw retainer ring 48, for example, by screws (not shown in FIG. 8) is the wire snagger 50.

Secured to the top of the spindle control rod 110 is a jaw actuator 130. The jaw actuator 130 has the form of an inverted transacted cone and includes a sloped or tapered cam surface complementary to an abutting surface of the cams 82, 84, 86. In the position shown, the jaw actuator 130 and control rod 110 are biased downwardly by the spring 132 so as to compress the compression springs 128 and retain the jaws 82, 84, 86 in a maximum outer diameter position. When it is desired to reduce the effective outer diameter of the jaws 82, 84 and 86, the foot pedal actuator 106 (FIG. 7) is actuated. The foot pedal actuator 106 engages actuator 108 on the bottom of the control rod 110 and moves the control rod 110 upwardly. The cam surfaces between the jaw actuator 130 and the jaws 82, 84, 86 will interact and the jaws 82, 84 and 86 will be urged inwardly by the springs 128 in order to permit the wire wound on the spools to be removed and discarded.

Inductive proximity sensor 127, which is secured to the bottom of the spindle housing base plate 80 cooperates with a small plate 129 affixed to the jaws base plate 120 for creating a pulse each time the small plate 129 passes the sensor 127 and thereby determining the speed or revolutions per minute of the jaw means 42. Such sensor 127 may be a suitable 900 Series proximity sensor made by Microswitch Division of Honeywell.

Sensor 133 is secured to the spindle housing base plate 80 below the baton mounting bracket 46 to sense when the baton 44 is in position in the baton mounting bracket 46.

The pulley 136 is operatively connected to the spindle shaft 88 for rotating same. The spindle shaft 88 in turn is secured to the bearing retainer plate 121 and the jaw base plate mounting flange 122 and is rotatable therewith and with the jaws 82, 84 and 86 carried thereon. It will be understood from FIG. 7 that the belt 92 is secured to the pulley 136 and to the output pulley of the variable speed motor 90 in order to drive the take-up jaws 42 to maintain a desired constant tension on the wire being wound.

The electric brake 94 is secured to the spindle stub shaft 138, that is in turn secured by suitable fastening means 140 to the spindle shaft 88. The electric brake 94 may be actuated as desired to stop the rotation of the take-up jaws 42. An acceptable electric brake is the Dodge Model IEB-475 made by Reliance Electric Company.

Turning to FIG. 9, there is illustrated the wire cutter 54, which basically comprises a circular rod having a milled or machined surface defining a point or knife edge 55.

With reference to FIG. 10, there is better known the wire snagger 50 of the present invention. The bottom 142 of the wire snagger 50 has a flat surface 141 adapted to be engaged with the top surface of the jaw retainer ring 48. An inclined surface 144 on the bottom 142 tapers rearwardly from the leading edge. The top 146 of the wire snagger 50 has a rounded outer end 148, which cooperates with the inclined surface 144 to define an entry area for receipt of a wire to be snagged. The wire will enter the opening and pass inwardly until it is grabbed by the wire snagger 50. Aligned holes 150 are adapted to receive fasteners, for example, cap screws (not shown) to join the two parts 142 and 146 of the wire snagger 50 to one another and connect same to the top of the jaw retainer ring 48. In the event that material adheres within the narrow opening of the wire snagger 50, the cap screws connecting the parts 142 and 146 may be loosened, the wire removed and then the screws tightened to permit continued operation.

With reference to FIGS. 11 and 12 there is shown an orientation block 156 that is adapted to be connected to the frame 70 of the mobile cart means 40 to properly position the mobile cart means 40 with respect to a station on frame 12. Cap screws or like fastening means pass through the openings 158 and 160 in block 156 for securing the flat surface 162 of the block 156 against a side of frame 70. The projection 164, which is of generally rectangular cross section as best seen in FIG. 12 is adapted to engage a recess or like indentation or opening in the frame 12 adjacent a selected station 14 for properly positioning the mobile transfer cart 40 with respect to a selected station.

Figures 13, 14, 15, 16:
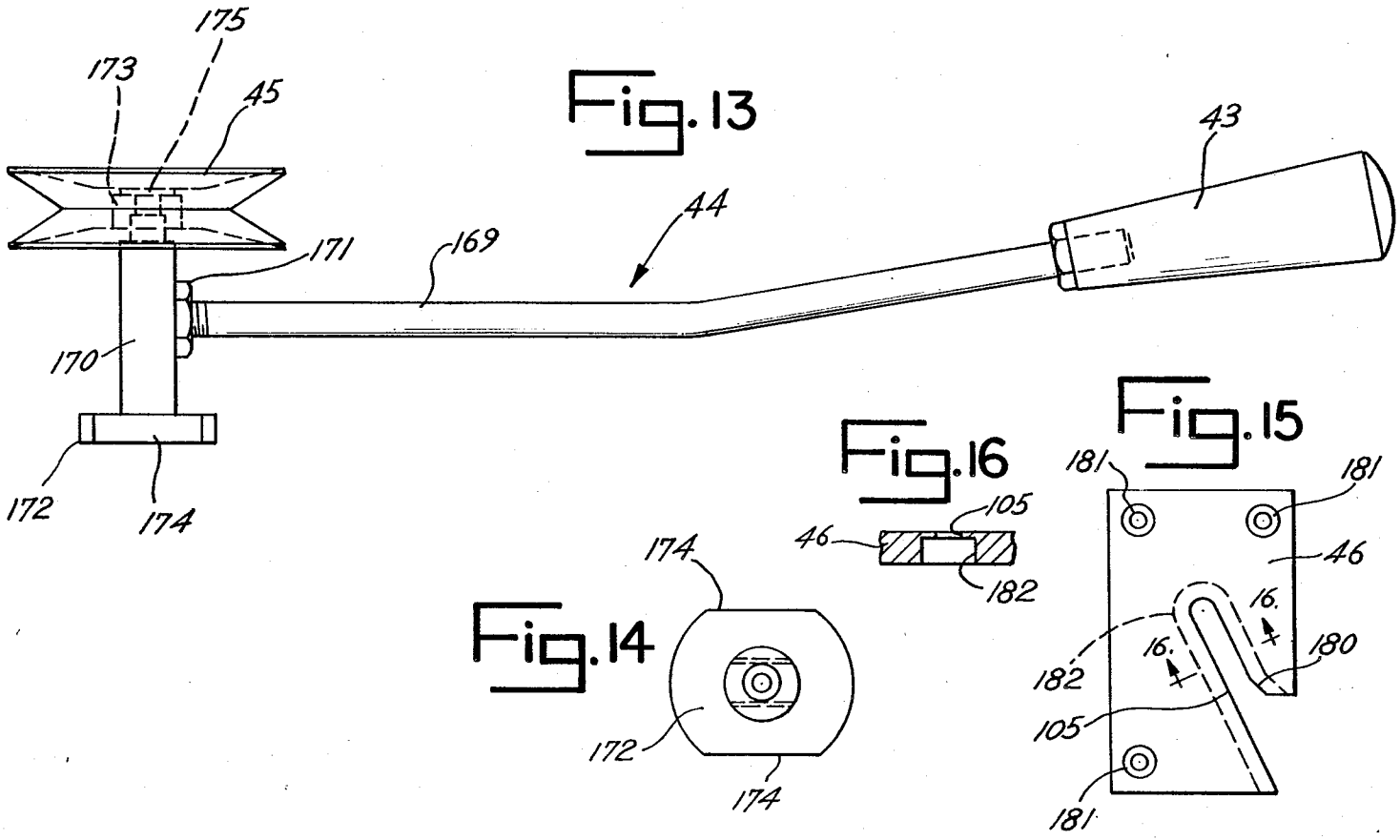
FIG. 13 is a side elevational view of the baton.
FIG. 14 is an end view of the guide on the baton, taken generally along the line 14—14 of FIG. 13.
FIG. 15 is a plan view of the baton mounting bracket.
FIG. 16 is a detail sectional view of the baton mounting bracket, taken generally along the line 16—16 of FIG. 15.

Turning to FIGS. 13 and 14, there is better shown the hand held baton 44 of the present invention. The baton 44 comprises a rod 169 having a handle 43 fixed to one end and a pulley 45 rotatably journalled on a support 170 suitably affixed to the end of rod 169 opposite from handle 43. The rod 169 may be threadedly connected to the support 170 and held in place by a lock nut 171. Also affixed to the support 170 is a guide 172 having a pair of parallel flat surfaces 174. The flat surfaces 174 of the guide 172 are adapted to engage within the slot in the baton mounting bracket 46 to properly position and support the baton 44 on the mobile transfer cart 40.

In FIGS. 15 and 16 there is better shown the baton mounting bracket 46. The slot or opening in the baton mounting bracket 46 has an enlarged entry 180 to facilitate introduction of the guide 172 on the baton 44 into the slot. As best seen in the detail sectional view in FIG. 16, the slot 105 is undercut with a lower slot 182. The surfaces 174 on guide 172 are adapted to be slid in between the walls defining the slot 182, with the top surface of the guide 172 below the shoulders formed at each side by the differential of the widths of the slots 105 and 182. The baton 44 will thus be held firmly in place in the mounting bracket 46 when needed to effect transfer of wire winding from the spool 34 to a take-up jaw means 42.

The present invention provides an improved structure and method for transferring wire from a full spool to an empty spool at a take-up station having a single turntable.

While a presently preferred embodiment of the invention has been shown and described, it is apparent that various changes and modifications may be made therein without departing from the invention. Therefore, it is intended to show all such changes and modifications as fall within the trust spirit and scope of the invention.

What is claimed:

1. In a system of winding wire on a spool means comprising a plurality of stations each having:

means for pulling the wire from a process toward the spool means;

adjustable means, operatively positioned between the pulling means and the spool means, for maintaining a relatively constant predetermined tension on the wire being wound;

variable speed turntable means, operatively connected to the spool means, for rotating the spool means; and traverse mechanism means, operatively positioned between the adjustable means and the variable speed turntable means, for adjusting reversal points of the wire as the wire is wound on the spool to form a constant pitch winding in successive opposed layers;

selection means operatively connected to the traverse mechanism means, and the variable speed turntable means, for selecting a specific spool means geometry associated with a specific spool means from a plurality of possible spool means geometry;

the improvement comprising mobile transfer cart means, selectively operatively connected to a station, for effecting transfer of the winding of the wire from the variable speed turntable means at the selected station to the mobile cart transfer means while spool means are being exchanged on said variable speed turntable means and for effecting transfer of the winding of the wire back to a different empty spool means operatively mounted on the variable speed turntable means.

2. A system as in claim 1 wherein the mobile transfer cart means includes a frame;

jaw means operatively positioned on the frame for accumulating wire during the exchange of spool means on the turntable means at the selected station;

wire guide means operatively positioned on the transfer cart means for accurately guiding the wire during the exchange of spool means on the turntable means at the selected station;

wire transfer control means for effecting transfer of the wire from the turntable means to the transfer cart means, and spindle release means operatively positioned on the transfer cart means and operatively connected to the jaw means for permitting removal of accumulated wire wound on the jaw means after the exchange of the spool means on the turntable means has been effected and the winding of the wire has been transferred from the transfer cart means back to the spool means on the turntable means.

3. A system as in claim 2 wherein the jaw means includes:

a spindle housing base plate, transfer spool jaws, a jaws base plate, a jaws base plate mounting flange for operatively connecting the jaws base plate to the spindle housing base plate, and a transfer spool jaws spindle shaft operatively connected to the transfer spool jaws for rotating same.

4. A system as in claim 3 wherein the jaw means includes jaw actuating means operatively connected to the transfer spool jaws for selectively varying the effective outer diameter of the transfer spool jaws, and spring means operatively connected to the transfer spool jaws for biasing the transfer spool jaws so as to reduce the effective outer diameter thereof.

5. A system as in claim 4 wherein the spindle release means includes a spindle control rod operatively connected to the jaws actuating means.

6. A system as in claim 5 wherein the spindle release means includes a spring biasing the spindle control rod.

7. A system as in claim 3 including wire snagger means operatively positioned on the transfer spool jaws retainer ring for snagging wire, wire cutter means operatively positioned on the spindle housing base plate for cutting wire snagged by the wire snagger means, and wire pull down means operatively positioned on the spindle housing base plate for locating the wire to be transferred to the transfer spool jaws so that the wire snagger means catches such wire and interacts such wire with the wire cutter means, thereby cutting the wire so that the wire is wound on the transfer spool jaws.

8. A mobile transfer cart for selectively winding wire thereon while spools are being exchanged on a spool turntable means, said cart comprising:

a frame;

jaw means, operatively positioned on the frame, for accumulating wire during the exchange of spools on the spool turntable means:

traverse assembly means operatively positioned on the transfer cart means for vertically adjusting the wire on the spool means prior to the exchange of spool means on the turntable means;

wire guide means operatively positioned on the transfer cart means for accurately guiding the wire during the exchange of spool means on the turntable means;

wire transfer control means for effecting transfer of the wire from the wire winding turntable means to the transfer cart means; and spindle release means operatively positioned on the cart and operatively connected to the jaw means for permitting removal of accumulated wire wound on the jaw means after the exchange of spool means on the turntable means has been effected and the winding of the wire has been transferred from the transfer cart means back to the spool means on the turntable means.

9. A mobile transfer cart as in claim 8 wherein the jaw means includes:

a spindle housing base plate, transfer spool jaws, a jaws base plate, and a jaws base plate mounting means operatively connected to the transfer spool jaws so as to reduce the effective outer diameter thereof.

10. A mobile transfer cart as in claim 8 including:

wire snagger means operatively positioned on the transfer spool jaws retainer ring for snagging wire, wire cutter means operatively positioned on the spindle housing base plate for cutting wire snagged by the wire snagger means, and wire pull down means operatively positioned on the spindle housing base plate for locating the wire to be transferred to the transfer spool jaws so that the wire snagger means catches such wire and interacts such wire with the wire cutter means, thereby cutting the wire so that the wire is wound on the transfer spool jaws.

11. A transfer cart for selectively winding wire thereon while spools are being exchanged on a turntable, said transfer cart comprising:

a frame;

a top, a bottom, two end and two side covers for operatively enclosing the frame;

a spindle housing base plate assembly comprising:

transfer spool jaws;

a spindle housing base plate;

a jaws base plate;

a jaws base plate mounting flange for operatively connecting the jaws base plate to the spindle housing base plate;

a transfer spool jaws retaining ring for operatively connecting the transfer spool jaws to the jaws base plate;

a transfer spool jaws spindle shaft operatively connected to the transfer spool jaws for rotating same;

actuating means operatively connected to the transfer spool jaws for selectively varying the effective outer diameter of the transfer spool jaws;

spring means operatively connected to the transfer spool jaws for biasing the transfer spool jaws so as to reduce the effective outer diameter thereof;

wire snagger means operatively positioned on the transfer spool jaws retainer ring for snagging wire;

wire cutter means operatively positioned on the spindle housing base plate for cutting wire snagged by the snagger means;

wire pull down means operatively positioned on the spindle housing base plate for locating the wire to be transferred to the transfer spool jaws so that the wire snagger means catches such wire and interacts such wire with the wire cutter means, thereby cutting the wire so that the wire is wound on the transfer spool jaws.

12. A transfer cart as in claim 11 wherein the transfer spool jaws and the actuating means have complementary abutting cam surfaces, said actuating means being movable longitudinally so as to move the cam surface thereon with respect to the cam surface on the transfer spool jaws, with movement of the actuating means in one direction increasing the effective outer diameter of the transfer spool jaws and compressing the spring means and movement of the actuating means in the opposite direction permitting the spring means to expand and reducing the effective outer diameter of the transfer spool jaws.

13. A transfer cart as in claim 11 wherein the actuating means includes a spindle control rod actuated longitudinally to enable movement of the cam surfaces so as to change the effective outer diameter of the transfer spool jaws.

14. A method for changing spools in a wire winding system including a plurality of stations having a single turntable carrying a spool at each station, comprising the steps of winding wire onto a plurality of rotatable spools, positioning a mobile transfer cart adjacent one of the spools prior to the spool being filled to capacity with wire, guiding wire being wound onto said one of the spools into position adjacent take up jaws on the mobile transfer cart, rotating the take-up jaws to a predetermined speed and snagging the wire, cutting the wire so as to wind wire on the take-up jaws, removing the full spool from its turntable and replacing it with an empty spool, rotating the empty spool to desired speed, snagging the wire on the rotating empty spool, cutting the wire so as to wind wire on the empty spool, while maintaining a desired tension in the wire, stopping the take-up jaws and removing the wound wire, and moving the mobile transfer cart to position adjacent another one of the plurality of spools upon which wire is being wound and repeating the operation.

15. A method as in claim 14 including the step of vertically adjusting the wire on the full spool prior to the exchange of spools on the turntable.

16. A method as in claim 14 including reducing the effective outer diameter of the take-up jaws to permit removal of the wound wire from the take-up jaws.

* * * * *